United States Patent [19]

Sommers et al.

[11] Patent Number: 4,889,183

[45] Date of Patent: Dec. 26, 1989

[54] METHOD AND APPARATUS FOR RETAINING SHAPED CHARGES

[75] Inventors: Kenneth C. Sommers; David S. Wesson, both of Katy; Kevin R. George, Columbus, all of Tex.

[73] Assignee: Halliburton Services, Duncan, Okla.

[21] Appl. No.: 218,998

[22] Filed: Jul. 14, 1988

[51] Int. Cl.[4] ..... E21B 43/117

[52] U.S. Cl. ..... 166/55; 175/3.5; 175/4.6; 102/310; 248/231.8

[58] Field of Search ..... 166/55, 55.1, 297; 175/3.5, 4.51, 4.52, 4.53, 4.54, 4.55, 4.6; 102/310; 248/52, 229, 230, 231.8

[56] References Cited

U.S. PATENT DOCUMENTS

| | | | |
|---|---|---|---|
| 2,036,655 | 4/1936 | Storaasli | 248/231.8 |
| 2,402,153 | 6/1946 | Elliott . | |
| 2,494,256 | 1/1950 | Muskat et al. | 102/20 |
| 2,742,857 | 4/1956 | Turechek | 102/20 |
| 2,750,885 | 6/1956 | Schlumberger | 102/20 |
| 2,756,677 | 7/1956 | McCullough | 102/20 |
| 2,764,938 | 10/1956 | Harcus | 102/20 |
| 2,873,676 | 2/1959 | Caldwell | 102/20 |
| 2,916,991 | 12/1959 | Gilbert | 102/20 |
| 2,947,250 | 8/1960 | Mohaupt | 102/20 |
| 3,036,521 | 5/1962 | Owen | 175/4.6 |
| 3,078,797 | 2/1963 | Blair | 102/20 |
| 3,444,810 | 5/1969 | Hakala | 102/310 |
| 3,565,188 | 2/1971 | Hakala | 175/4.6 |
| 3,739,723 | 6/1973 | Hakala | 175/4.6 |
| 3,762,326 | 10/1973 | Edgell et al. | 102/20 |
| 3,773,119 | 11/1973 | Shore | 175/4.6 |
| 4,140,188 | 2/1979 | Vann | 175/4.51 |
| 4,312,273 | 1/1982 | Camp | 175/4.6 |
| 4,326,462 | 4/1982 | Garcia et al. | 102/310 |
| 4,371,044 | 2/1983 | Willig et al. | 175/4.6 |
| 4,428,440 | 1/1984 | McPhee | 175/4.6 |
| 4,479,556 | 10/1984 | Stout et al. | 175/4.6 |
| 4,519,313 | 5/1985 | Leidel | 102/310 |
| 4,523,649 | 6/1985 | Stout | 175/4.51 |
| 4,523,650 | 6/1985 | Sehnert et al. | 175/4.56 |
| 4,534,423 | 8/1985 | Regalbuto | 175/4.6 |
| 4,541,486 | 9/1985 | Wetzel et al. | 166/297 |
| 4,543,703 | 10/1985 | Wetzel et al. | 175/4.6 |
| 4,583,602 | 4/1986 | Ayers | 175/4.51 |
| 4,635,734 | 1/1987 | Donovan et al. | 175/4.6 |
| 4,753,301 | 6/1988 | Berry | 166/55 |

*Primary Examiner*—Jerome W. Massie, IV
*Assistant Examiner*—Terry Lee Melius
*Attorney, Agent, or Firm*—Arnold, White & Durkee

[57] ABSTRACT

The invention provides a perforating assembly and a method and apparatus for retaining shaped charges in a charge carrier. A shaped charge body has two clips associated with it: a band clip having a plurality of radially extending tabs oppositely oriented for mounting the shaped charge body in the charge carrier, and for securing the shaped charge body in place; and a wire clip mounted on the shaped charge body and adapted to hold a detonating cord in contact with the shaped charge.

12 Claims, 2 Drawing Sheets

FIG.1
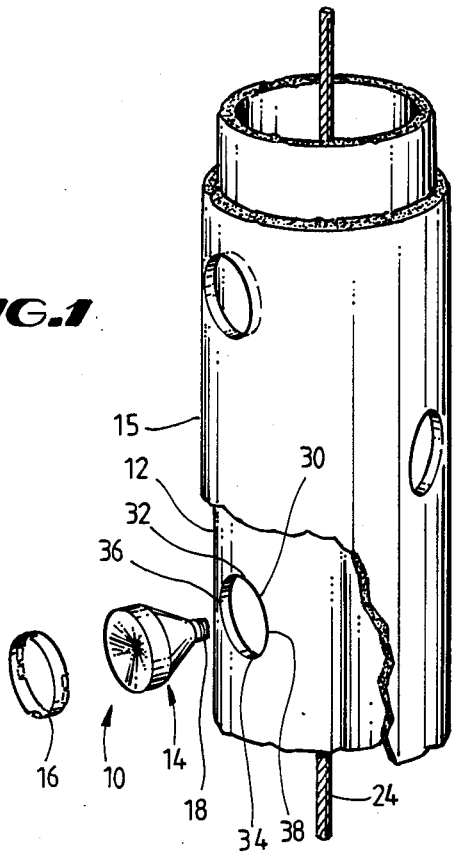
FIG.2A
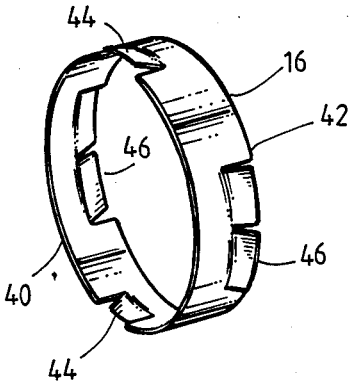
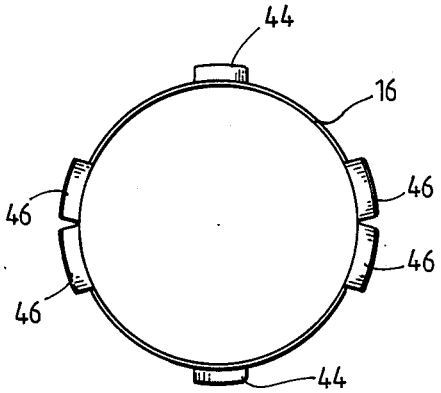
FIG.2B

FIG.3A
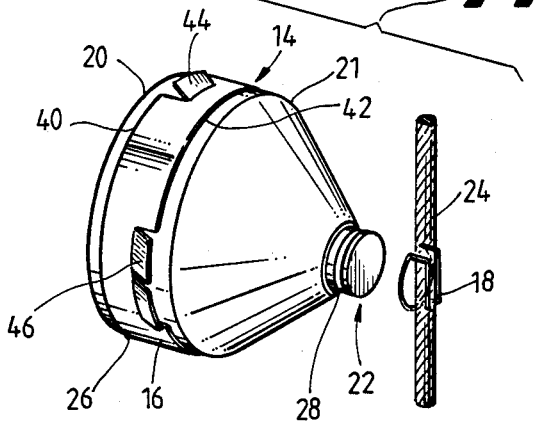
FIG.3B
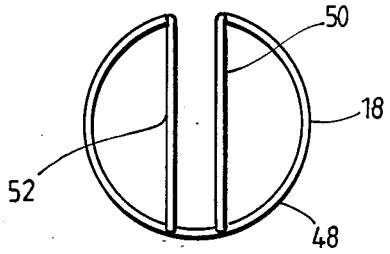
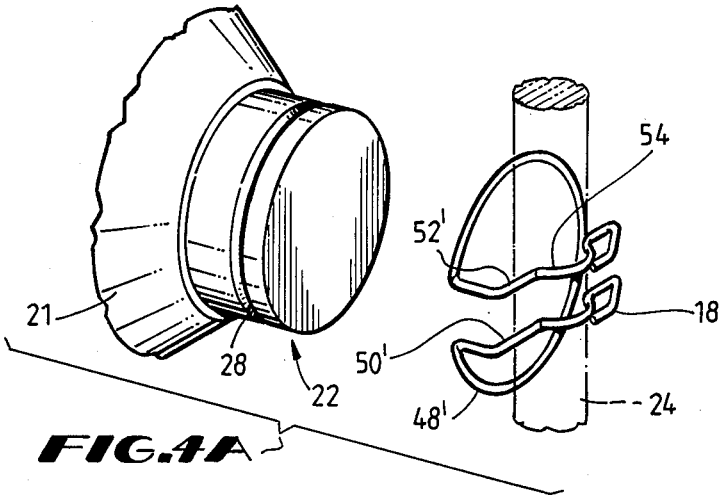
FIG.4A
FIG.4B
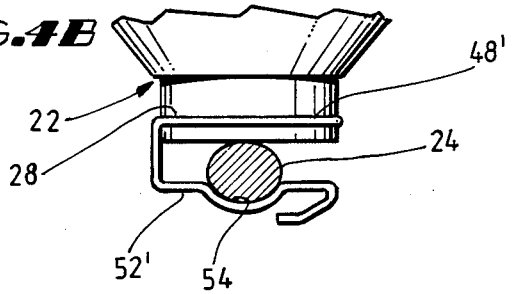

METHOD AND APPARATUS FOR RETAINING SHAPED CHARGES

BACKGROUND OF THE INVENTION

The present invention relates generally to methods and apparatus for perforating, and more specifically relates to methods and apparatus for retaining shaped charges in a perforating gun.

After an oil or gas well is drilled, casing is typically placed in the well to line the side of the wellbore. Before the well is placed on production, the casing and the producing formation are perforated. Ordinarily, perforating guns are lowered into the well until they are adjacent the formation to be produced. The guns are then detonated, perforating the casing and the formation, and the well may be produced.

Typically, the perforating gun includes a plurality of shaped charges mounted at spaced intervals in a charge carrier. The shaped charges are detonated by means of a detonating cord. Typically the charge carrier takes the form of a hollow cylindrical tube retained within a housing. The housing is adapted to be coupled to the tubing string or to a wireline. The charge carrier tube will include apertures, machined or stamped in the side of the carrier tube, to receive the shaped charges.

In the past, the shaped charges have been mounted in the charge carrier by means of various apparatus, including flat retention bands, threaded assemblies, and bolted flanges. Typically, these prior art apparatus have served to both retain the charges in place in the charge carrier and hold the detonating cord in contact with the shaped charges. As a result, when installing the shaped charges in the charge carrier, it has been necessary to simultaneously ensure that the detonating cord is properly aligned in the mounting clip with the shaped charge.

These conventional methods of mounting shaped charges has several disadvantages. First, the methods are very time consuming since such typical conventional mounting apparatus must be separately inserted into the charge holder before the shaped charge is installed. In addition, conventional mounting apparatus typically cannot satisfactorily be attached to either the shaped charges or the charge carrier prior to assembly of the shaped charge in the carrier. These conventional apparatus thus provide extra pieces to assemble at the well site, and may be easily lost or misplaced.

Accordingly, the present invention provides a securing method and apparatus whereby a shaped charge can be easily mounted in the charge holder and operatively secured to the detonating cord; and whereby the securing apparatus may be affixed to the shaped charges prior to mounting of the shaped charges in the perforating gun.

SUMMARY OF THE INVENTION

In one preferred embodiment, the present invention provides a securing method and apparatus for mounting shaped charges in a charge holder and for holding a detonating cord in contact with the shaped charge through use of two novel clip members. In a particularly preferred embodiment, the shaped charge has two circumferential grooves on its outer surface. A band clip is adapted to fit within one of the circumferential grooves. On one periphery, the band clip has a first set of radially outwardly biased tabs adapted to engage the charge carrier at a first group of locations to prevent movement of the shaped charge inwardly. In the opposite periphery, the band clip has a second set of radially outwardly biased tabs to contact the charge carrier at a second group of locations to prevent outward movement of the shaped charge. A wire clip is mountable in the second circumferential groove on the shaped charge. This wire clip is adapted to engage the detonating cord and to retain it in contact with the shaped charge.

In operation of this particularly preferred embodiment, the band clip and the wire clip are mounted on the shaped charge to form a shaped charge assembly. The detonating cord is run through a carrier tube, and the shaped charge assembly is inserted into the holes in the carrier tube; the band clip tabs lock the shaped charge securely in place, and the detonating cord is then be inserted into the wire clip, securing the detonating cord in operative relation with the shaped charge.

BRIEF DESCRIPTION OF THE DRAWINGS

FIG. 1 depicts a perforating gun and a shaped charge assembly in accordance with the present invention depicted in an exploded perspective view.

FIGS. 2A–B depict an exemplary band clip of the shaped charge assembly of FIG. 1, illustrated from an oblique view in FIG. 2A, and from a plan view in FIG. 2B.

FIGS. 3A–B depict a wire clip in accordance with the present invention with a shaped charge assembly illustrated from an oblique view in FIG. 3A, and from a plan view in FIG. 3B.

FIGS. 4A–B depict an alternate embodiment of a wire clip in accordance with the present invention, illustrated from an oblique view in FIG. 4A and from a top view in FIG. 4B.

DETAILED DESCRIPTION OF THE PREFERRED EMBODIMENT

Referring now to FIG. 1, therein is depicted an exemplary shaped charge assembly 10 in accordance with the present invention, illustrated in an exploded view relative to a charge carrier tube 12 of a perforating gun 15. Shaped charge assembly 10 includes a shaped charge 14, a band clip 16 and a wire clip 18.

Shaped charge 14 includes a body 21, with a detonating end 20 and a primer end 22 (shown in greater detail in FIG. 3A). Primer end 22 is adapted to contact a detonating cord 24. Primer end may include a "nipple" as depicted herein, or may be of other conformities, such as a conical portion. When detonating cord 24 is actuated, it detonates shaped charge body 21 at primer end 22, resulting in explosion of shaped charge 14 from detonating end 20. When the perforating gun 2, including charge carrier 12 and shaped charge assemblies 10, is suspended from a wireline or tubing string in a well bore adjacent a producing formation, the explosion results in perforation of the casing and producing formation.

Shaped charge body 21 has a first circumferential groove 26 located on its outer periphery, proximate detonating end 20. First groove 26 is adapted to receive band clip 16. First groove 26 will preferably have a width generally proximate that of band clip 16.

Shaped charge body 26 also has a second circumferential groove 28 located around its outer periphery, proximate primer end 22. Second groove 28 is adapted to receive circular portion 29 of wire clip 18.

Charge carrier 12 i preferably a hollow, generally cylindrical tube, which is adapted to be retained within housing 31. Charge carrier 12 has a plurality of apertures 30 machined or stamped in the outer surface and adapted to receive the round shaped charge bodies 21. Apertures 30 may be positioned in any desired configuration in charge carrier 12, such as in a conventional multiple spiral configuration. Because the outer surface of carrier 12 is curved, apertures 30 appear to "wrap around" charge carrier 12. Thus, sides 32 and 34 of aperture 30, arranged parallel to the longitudinal axis of charge carrier 12, are in a different, radially offset, plane relative to sides 36 and 38 of aperture 30, located approximately ninety degrees removed from side 32 and 34. The radial distance between the plane of sides 32 and 34 and the plane of sides 36 and 38 will vary as a function of the diameter of charge carrier 12. The width of band clip 16 will preferably be established approximately equal to the radial offset between these two planes.

Referring now to FIGS. 2A–B, shown therein in greater detail is band clip 16 in accordance with the present invention. Band clip 16 is preferably formed of flat spring steel, formed into a generally circular shape. The ends of band clip 16 are preferably not joined together, but are allowed to overlap, to allow circumferential expansion of band clip 16. Band clip 16 has a first peripheral side 40 and a second peripheral side 42. Locking tabs 44 are formed in first peripheral side 40 of band clip 16. As best seen in FIG. 2*a*, locking tabs 44 are radially outwardly biased. Locking tabs 44 are spaced so as to be diametrically opposed when band clip 16 is expanded and placed around shaped charge body 21. Locking tabs 44 may be formed by cuts extending partially through the width of band clip 16, with the separated portion bent outwardly from the center of band clip 16. Additional diametrically opposed tabs 46 are formed in second peripheral side 42 of band clip 16. Locking tabs 46 are positioned on band clip 16 spaced approximately 90 degrees apart from locking tabs 44. Tabs 46 are formed from the second side 42 of band clip 16 and again extend radially outward. Preferably, locking tabs 46 include double adjacent tabs at each location (each tab being about 0.375 inches in one preferred embodiment), while tabs 44 are single tabs at each location.

When band clip 16 is mounted on shaped charge body 21, first peripheral side 40 is positioned proximate detonating end 20 of shaped charge body 21. When shaped charge assembly 10 is mounted in carrier 12, locking tabs 44 are aligned with the longitudinal axis of charge carrier 12 and engage sides 32 and 34 of apertures 30. Locking tabs 46 are aligned perpendicular to the longitudinal axis of charge carrier 12 and engage sides 36 and 38 of apertures 30.

As best seen in FIG. 3A, due to the effect of apertures 30 "wrapping around" the outer surface of charge carrier 12, the first side 40 of band clip 16 engages sides 32 and 34 of aperture 30 at the same time that second side 42 of band clip 16 engages sides 36 and 38 of aperture 30. Locking tabs 44 engage charge carrier tube 12 from the inside, while locking tabs 46 engage charge carrier 12 from the outside. Therefore, when shaped charge assembly 10 is mounted in carrier tube 12, locking tabs 44 prevent outward movement of shaped charge assembly 10, while tabs 46 prevent inward movement.

Referring now to FIG. 3B, shown therein in greater detail is an exemplary embodiment of a wire clip 18 in accordance with the present invention. Wire clip 18 includes a generally circular section 48 which is adapted to engage second circumferential groove 28 of charge body 14. Wire clip 18 includes a pair of arms 50 and 52 which extend outwardly from the circular section 48. As shown in FIG. 2, arms 50 and 52 are generally parallel. Arms 50 and 52 are spaced apart a sufficient amount to receive detonating cord 24 between them. As shown in FIG. 3A, when wire clip 18 is mounted on shaped charge body 21, detonating cord 24 may be placed between arms 50 and 52 of wire clip 18 and held in contact with primer end 22 of shaped charge 14.

Referring now to FIGS. 4A–B, depicted therein is an alternate embodiment of wire clip 18′ in accordance with the present invention. Wire clip 18′ has a generally circular section 48′ which is adapted to engage with the second circumferential groove 22 of shaped charge body 21. Arms 50′ and 52′ extend outwardly from the circular section 48′. Arms 50′ and 52′ are shaped to form a semicircular channel 54. Channel 54 is adapted to receive detonating cord 24, which is held in contact with the shaped charge under arms 50′ and 52′ and generally perpendicular to arms 50′ and 52′.

The method of installing shaped charges in a charge carrier using a shaped charge assembly 10 will be described primarily in reference to FIG. 1. A detonating cord 24 is placed inside charge carrier 12. Band clip 16 is expanded to fit around shaped charge 21 in first groove 26, and wire clip 18 is installed within second groove 28 in shaped charge body 21, to form shaped charge assembly 10. Shaped charge assembly 10 is inserted into aperture 30 in charge carrier 12. Locking tabs 44 are aligned with the longitudinal axis of carrier tube 12, and the assembly is inserted into aperture 30. When shaped charge assembly 10 is inserted in aperture 30, locking tabs 44 engage sides 32 and 34 of hole 30. As charge assembly 10 is inserted, locking tabs 44 are displaced radially inward. When charge assembly 10 is fully inserted, locking tabs 44 spring radially outward and engage with sides 32 and 34 of aperture 30 to retain shaped charge body 14 in place. In addition, tabs 46 engage with sides 36 and 38 of hole 30 to prevent further inward movement of shaped charge body 14. After shaped charge assembly is mounted in carrier tube 12, detonating cord 24 is inserted between arms 50 and 52 of wire clip 18. Alternatively, detonation cord 24 may be clipped to shaped charge assembly 10, prior to installation of shaped charge assembly 10 in carrier tube 12.

Many modifications and variations may be made in the techniques and structures illustrated herein without departing from the spirit and scope of the present invention. Accordingly, the techniques and structures described herein are illustrative only and are not to be considered as limitations upon the scope of the present invention.

What is claimed is:

1. Apparatus for mounting a shaped charge in a carrier, such shaped charge having a detonation end and a primer end, comprising:

a band clip mounted on said shaped charge and having a first side proximate said detonation end of said shaped and a second opposite said first side;

said band clip including a first radially outwardly biased tab adapted to cooperate with said carrier to retain said shaped charge in said carrier and prevent movement of said shaped charge relative to said carrier in a first direction when said shaped charge is mounted in said carrier; and a second radially outwardly biased tab oppositely oriented adapted to cooperate with said carrier to retain said shaped charge in said carrier and prevent movement of said shaped charge relative to said carrier in a second direction when said shaped charge is mounted in said carrier.

2. The apparatus of claim 1, further comprising a wire clip mounted on said shaped charge proximate said primer end of said shaped charge, said wire clip having at least one arm spaced from said shaped charge, said arm adapted to hold a detonation cord proximate said primer end of said shaped charge.

3. The apparatus of claim 2 wherein said wire clip comprises two generally parallel arms spaced from said shaped charge, said arms adapted to receive between them a detonating cord.

4. The apparatus of claim 2 wherein said band clip is mounted on said shaped charge in a first circumferential groove on said shaped charge, and wherein said wire clip is mounted on said shaped charge in a second circumferential groove on said shaped charge.

5. The apparatus of claim 1 wherein said first radially outwardly biased tab is positioned on said band clip at said first side.

6. The apparatus of claim 1 wherein said second radially outwardly biased tab is positioned on said band clip at said second side.

7. A method of mounting a shaped charge in a carrier, comprising:

placing a detonating cord inside said carrier;

clipping a shaped charge to said carrier through use of a band clip having radially extending tabs oppositely oriented, mounted on said shaped charge, said tabs adapted to engage said carrier and to prevent outward and inward movement of said shaped charge relative to said carrier when said shaped charge is mounted in said carrier; and clipping said detonating cord to said shaped charge.

8. The method of claim 7 wherein the step of clipping said detonating cord to said shaped charge is accomplished by means of a wire clip mounted on said shaped charge and adapted to retain said detonating cord.

9. A shaped assembly mountable in a carrier, comprising:

a charge body having a detonation end and a primer end;

a first clip coupled to said charge body and adapted to cooperate with said carrier to mount said shaped charge in said carrier;

said first clip including tabs oppositely oriented adapted to engage said carrier and prevent outward and inward movement of said shaped charge relative to said carrier when said shaped charge is mounted in said carrier; and a second clip coupled to said charge body and adapted to retain a detonation cord proximate said shaped charge.

10. A perforating assembly, comprising:

housing;

a charge carrier, having at least one aperture therein; and a shaped charge assembly, comprising, a shaped charge having at least one peripheral groove, and a first clip adapted to engage said peripheral groove in said shaped charge, and to engage said charge carrier to retain said shaped charge in said carrier;

said first clip including tabs oppositely oriented adapted to engage said charge carrier and prevent outward and inward movement of said shaped charge relative to said charge carrier when said shaped charge is mounted in said charge carrier.

11. The perforating assembly of claim 10, wherein said charge carrier is generally tubular.

12. The perforating assembly of claim 10, wherein said shaped charge includes a second peripheral groove, and wherein said shaped charge assembly further comprises a second clip adapted to engage said second peripheral groove and said shaped charge and to retain a detonating cord proximate said shaped charge.

* * * * *

UNITED STATES PATENT AND TRADEMARK OFFICE

CERTIFICATE OF CORRECTION

PATENT NO. : 4,889,183

DATED : December 26, 1989

INVENTOR(S) : Kenneth C. Sommers, et al.

It is certified that error appears in the above-identified patent and that said Letters Patent is hereby corrected as shown below:

In the abstract, line 5, after "extending", please insert --oppositely oriented--.

In the abstract, line 5, after "tabs", please delete "oppositely oriented".

In column 4, line 63, after "shaped", please insert --charge--.

In column 4, line 63, after "second", please insert --side--.

In column 5, line 3, after "biased", please insert --oppositely oriented--.

In column 5, lines 3 and 4, after "tab", please delete "oppositely oriented".

In column 5, line 34, after "extending", please insert --oppositely oriented--.

In column 5, lines 34 and 35, after "tabs", please delete "oppositely oriented".

In column 6, line 10, after "including", please insert --oppositely oriented--.

In column 6, line 10, after "tabs", please delete "oppositely oriented".

In column 6, line 20, before "housing", please insert --a--.

UNITED STATES PATENT AND TRADEMARK OFFICE

CERTIFICATE OF CORRECTION

PATENT NO. : 4,889,183

DATED : December 26. 1989

INVENTOR(S) : Kenneth C. Sommers, et al.

It is certified that error appears in the above-identified patent and that said Letters Patent is hereby corrected as shown below:

In column 6, line 29, after "including", please insert --oppositely oriented--.

In column 6, line 29, after "tabs", please delete "oppositely oriented".

Signed and Sealed this

Fourth Day of December, 1990

*Attest:*

*Attesting Officer*

HARRY F. MANBECK, JR.

*Commissioner of Patents and Trademarks*